United States Patent [19]

Hieronymus

[11] 4,314,123

[45] Feb. 2, 1982

[54] CURRENT FEED FOR A SUPER-CONDUCTING MAGNET COIL

[75] Inventor: Hans Hieronymus, Erlangen, Fed. Rep. of Germany

[73] Assignee: Siemens Aktiengesellschaft, Berlin and Munich, Fed. Rep. of Germany

[21] Appl. No.: 107,713

[22] Filed: Dec. 27, 1979

[30] Foreign Application Priority Data

Jan. 18, 1979 [DE] Fed. Rep. of Germany ..... 2901892

[51] Int. Cl.[3] ..... H01H 1/62

[52] U.S. Cl. ..... 200/289; 200/239; 200/267

[58] Field of Search ..... 200/165, 238, 239, 250, 200/267, 289; 335/216

[56] References Cited

U.S. PATENT DOCUMENTS

| | | | |
|---|---|---|---|
| 3,278,808 | 10/1966 | Bonfeld | 335/216 |
| 3,469,050 | 9/1969 | Robinson et al. | 200/239 |
| 3,521,207 | 7/1970 | Britton et al. | 335/216 |
| 3,551,861 | 12/1970 | Boom et al. | 335/216 |
| 3,689,856 | 9/1972 | Lambert et al. | 200/267 |
| 3,839,689 | 10/1974 | Biltcliffe et al. | 335/216 |

FOREIGN PATENT DOCUMENTS

| | | | |
|---|---|---|---|
| 311299 | 10/1971 | U.S.S.R. | 335/216 |

*Primary Examiner*—John W. Shepperd
*Attorney, Agent, or Firm*—Kenyon & Kenyon

[57] ABSTRACT

In a current feed for a superconducting magnet coil that can be short circuited, with a disconnecting device for separating a movable from a stationary cooled contact element, the mass ratio of the cooled contact element to the movable contact element is at least 5:1 and the cooled contact element is of elongated shape in the direction of the current flow, has a thermal resistance of at least 0.2 K/W for each 1000 amperes of current to be transmitted, has its end facing away from the contact region provided with cooling fins and is connected to the end of the coil, thereby keeping the amount of heat transmitted from the warm to the cold contact element relatively small and preventing undue warming of the coil end.

13 Claims, 3 Drawing Figures

CURRENT FEED FOR A SUPER-CONDUCTING MAGNET COIL

BACKGROUND OF THE INVENTION

The invention relates to superconductors in general and more particularly to a current feed for a superconducting magnet coil which is cooled by a cryogenic medium.

In a superconducting magnet coil, the coil ends can be short circuited by a continuous current switch. This switch has a disconnecting device at each coil end which contains a stationary contact member which is connected to the respective coil end and is included in the cooling effect of a cryogenic medium cooling the coil, and a movable contact member connected to a current supply, as well as a mechanical actuating device for joining the contact members with a predetermined contact pressure and for separating them after the magnet coil is short-circuited.

For feeding current into magnet coils with deep cooled superconductors, current feeding devices are required, through which an electric current is fed to these conductors from a power supply which is at a higher temperature level, e.g., at room temperature. The conductors of the magnet coil are held at a temperature level below the so-called transition temperature of its superconductive material by means of a cryogenic medium, for instance, liquid helium. Since this transition temperature of the known superconductive materials is far below room temperature, conductor parts of electrically normally conducting material such as copper or aluminum are used for bridging the temperature differences in the current feeds. These normally conducting conductor parts are then connected to the superconductors of the magnet coil at a point which is also held at a temperature level below the transition temperature of the superconductor material.

If a magnetic field has been set up in such a magnet coil by a corresponding current, the coil can be short-circuited via a continuous-current switch, because practically no energy need be supplied to it any more from the outside to maintain the field. Only the energy required to maintain the superconducting state of the coil must then still be supplied. Switches with a particularly low resistance are suited as continuous current switches, so that current can flow in the shorted circuit formed by the coil and the continuous current switch almost without attenuation. (see, for instance, U.S. Pat. No. 4,024,363 and German Offenlegungsschrift No. 27 07 589).

However, heat is always fed to the cryogenic medium which cools the conductors of the magnet coil through the normally conducting conductor parts of a current feed, which are still connected, although current need no longer be supplied, during the continuous operation when the magnet coil is excited and shorted. To avoid corresponding heat losses, the current feed can therefore be provided with an interrupting device, in order to disconnect electrically and thermally highly conducting conductor parts of the current feed which are connected to the power supply, which is at room temperature, during continuous operation of the magnet coil, from conductor parts which are in the cryogenic medium (see, for instance, the journal "Elektrie" vol. 19 (1965), no. 4, page 179). A suitable disconnecting device contains, in general, a stationary cold contact element and movable warm contact element as well as a mechanical actuating device, with which the contact elements can be joined together with a predetermined contact pressure and can be disconnected from each other after the magnet coil is shorted.

In the design of such a current feed with a disconnecting device, the difficulty arises of necessity that the remote contact element which is warmed up to, say, room temperature, must be brought into thermal contact with the cold contact element and therefore warms up the latter. The greatly different specific heats of these two contact elements must be taken into consideration in this connection. Then, the danger may exist that too much heat will be introduced into the cold contact element and thereby into the coil lead connected thereto and the superconductive material will become normally conducting at least at that point. This danger is present mainly prior to a de-energizing action, when the full current still flows in the magnet coil.

SUMMARY OF THE INVENTION

It is therefore an object of the present invention to provide a current feed with a disconnecting device in which these difficulties are reduced substantially. It should be possible, in particular, to keep the temperature of the joint, even immediately after joining the warm contact element to the cold contact element, so low that, with proper cooling of the parts of the feed, the direct danger of the super-conductor becoming normally conducting is practically non-existent.

According to the present invention, this problem is solved for a current feed of the type mentioned at the outset by the following features:

(a) the mass ratio of the cooled contact element to the movable contact element is at least 5:1, (b) the cooled contact element is of elongated shape in the current flow direction and its end facing away from the contact zone is provided with means for enlarging the surface area and is connected to the end of the coil, and (c) the thermal resistance of the cooled contact element between the contact zone and the connection point of the coil end is at least 0.2 K/W per each 1000 A of current maximally to be transmitted.

An elongated shape of the cooled contact element in the current flow direction is understood here to mean a shape, the length of which between the contact zone and the connection point for the superconductors is substantially larger than its average dimension in the direction perpendicular thereto.

The advantages of this type of design of a current feed are in particular that, in the separated condition of its contact elements, there is practically no heat conduction into the cryogenic medium via the current feed and the influx of heat is relatively small even when the contact elements are joined together, since, due to the large mass ratio chosen, only a correspondingly small amount of heat can pass from the warm to the cold contact element. In addition, this amount of heat does not get directly to the connected superconducting coil end because the cooled contact element is of relatively elongated shape and has a predetermined minimum heat resistance. Thus, a temperature gradient advantageously develops immediately across the cold contact element after the warm and the cold contact elements are joined together, and the heat transferred to the cold contact element is given off at the end facing away from the contact area of the latter through a large surface area to the cooling cryogenic medium before it can warm up the connected superconducting coil end. The danger of the superconductor of the magnet coil becoming normally conducting is therefore slight.

In addition, the time until the cold contact element is cooled off completely again is relatively short and is, for instance, some 10 seconds if the thermal resistance of the cooled contact element is at most 3 K/W per 1000 A of current to be transmitted.

The mass ratio between the warm and the cold contact element is advantageously chosen very large and is, for instance, at least about 10:1. The upper limit of this mass ratio is determined particularly by the mechanical load carrying capacity of the smaller warm contact element under the influence of the contact pressure. In the closed condition of the disconnecting device, the contact force can be at least 500 N, but preferably at least 1000 N.

According to a further embodiment of the current feed of the present invention, at least one of the contact surfaces of the two contact elements is curved and preferably of spherical shape. Under the influence of a relatively large contact pressure, a low contact resistance between the two contact elements of the disconnecting device is thus achieved.

This contact resistance is especially low if the sides of the contact elements which consist, for instance, of copper and face each other, are each provided with a contact surface of fine silver.

In addition, the current feed according to the present invention can advantageously be associated with a shorting switch shunted across the continuous current switch and with a mechanical actuating device which, depending on the switching condition of the disconnecting device, keeps the shorting switch open if the contact elements are joined together, and closed if the contact elements are separated. This prevents an unintentional or premature opening of the continuous current switch of the energized magnet coil which can cause damage to or even destruction of the continuous current switch and high electric voltages at the ends of the coils, if the contact elements of the current feeds are not yet joined together.

DETAILED DESCRIPTION OF THE INVENTION

Figure 1:
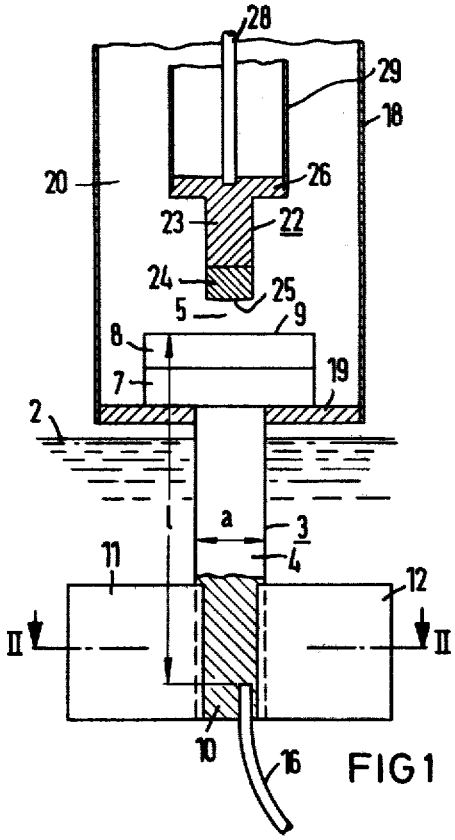
FIG. 1 is a cross sectional view of a current feed for a superconducting magnet coil.

With the current feed, which is shown in FIG. 1 only in part as a longitudinal section, a superconducting magnet coil, not shown in the figure, can be connected to a power supply at room temperature, also not shown. The magnet coil is inside a cryostat in a bath 2 of a cryogenic medium such a liquid helium, by means of which the superconducting conductors of the coil are kept below the transition point from the superconducting to the normally conducting state characteristic of this superconductive material. The current feed contains a stationary contact member 3 which is substantially immersed in the bath 2 and is therefore cooled, with a solid cylindrical part 4 which is elongated in the flow direction of the current and changes into a disc shaped horizontal part 7 at its upper end which protrudes from the bath 2 and faces a contact region 5. The side of this disc shaped part facing the contact region 5 is provided with a contact 8 with a plane contact surface 9. To the end 10 of the elongated part 4 of the contact element 3, facing away from the contact region 5, several cooling fins are fastened, of which only two fins 11 and 12 are visible in the view of FIG. 1. However, as shown by the cross section through these cooling fins in FIG. 2, still other cooling fins 13 and 14 can be attached to the lower end 10 of the contact element 3. By means of the cooling fins, cooling of the lower end 10 of the contact element 3 over a large surface area is achieved, so that this end has, at least approximately, the temperature of the cryogenic medium in the bath 2. To this end, a superconducting end section 16 of the magnet coil can therefore be connected advantageously.

The stationary position of the cooled contact element 3 is ensured by means of a thin walled vertical steel tube 18, the upper end of which is fastened to a housing, not shown in the figure, and the lower end of which is fastened to a plate 19 which is connected to the part 7 of the contact element 3 located outside the bath 2.

In the space defined by the steel tube 18 and the plate 19, which is open at the top, a movable contact element 22 of the current feed, which is movable in the vertical direction along the axis of the tube by means of an actuating device, not shown in the figure, is arranged. This contact element also contains a solid cylindrical part 23 which is provided at its lower end facing the contact region 5 with a contact 24 having a curved, preferably slightly spherical contact surface 25. The upper end of the contact element 22 facing away from the contact region is enlarged to form a disc shaped part 26, to which an electrical lead 28 is fastened, via which the contact element 22 is connected to the external power supply unit. This lead consists, for instance, of a copper screen or braid, the cross section of which is predetermined in accordance with the Joule losses produced, and which is cooled by evaporating helium. This lead is concentrically surrounded by a thin-walled rigid steel tube 29 which is fastened to the disc shaped part 26 and represents a mechanically strong connection between the actuating device, not shown in the figures, and the contact element 22. By means of this actuating device, the contact element 22 is advantageously pressed against the contact 8 of the stationary cold contact element 3 with a force of at least 500 N and preferably with at least 1000 N, for instance, 2000 N, or is separated therefrom. By fixing the stroke, the temperature of the warm contact element 22 in the lifted condition can optionally be influenced.

If fine silver is chosen as the material for the contacts 8 and 24, a particularly low contact resistance is assured, between the contact elements 22 and 3, because of the high contact pressure and the corresponding shape of the contact surfaces 9 and 25. The parts 23 and 26 of the contact element 3 as well as the cooling fins 11 to 14 consist advantageously of a normally conducting, electrically and thermally highly conductive material such as copper.

It is provided, according to the present invention, that the mass of the lower contact element 3, which is kept at the low temperature by the helium bath 2, is very large as compared to the upper movable warm contact element 22. The mass ratio should be at least 5:1 but preferable at least 10:1. The upper limit of this ratio is determined by the mechanical strength of the warm contact element 22 under the influence of a given contact force. It is achieved by this measure that, when the still warm contact element 22 is joined to the cold contact element 3, an accordingly limited amount of heat is transferred to the contact element 3. In order to prevent this heat from being passed on immediately to the superconducting coil end 16, the cold contact element is furthermore made so that it has a heat resistance of at least 0.2 K/W and preferably of at least 0.5 K/W per 1000 A of current maximally to be transmitted. The upper limit of the heat resistance is determined mainly by the Joule heat produced and the maximally permissible time for the contact element 3 to cool off again. It is advantageous if values of more than 3 K/W and preferably, if more than 1 K/W per 1000 A of current are not exceeded. In this manner it is ensured that the contact element 3 is cooled down again even at the end connected to the movable contact element 22, within a relatively short time, say, in less than 1 minute. The desired heat resistance of the contact element 3 is obtained with given material properties by making its length 1 in the vertical direction at least twice as large as its average dimension in the horizontal direction. The cold contact element 3 therefore contains an elongated, solid cylindrical part 4 with a small horizontal dimension a. Due to the cooling fins 11 to 14, additionally attached to its lower end, it is ensured that this end 10 with the superconducting end section 16 of the magnet ccoil connected thereto is always, at least approximately, at the temperature of the helium bath 2. With a short time after the two contact elements 3 and 22 have been joined together, a temperature gradient then develops across the elongated part 4 of the contact element 3, which is broken down again almost completely in a relatively short time. Because of the heat resistance of predetermined magnitude between the joined contact surfaces 9 and 25 on the one hand and the superconducting lead 16 of the magnet coil on the other hand, a sudden temperature increase at the conductors of the magnet coil is thus prevented.

EXAMPLE

Figure 2:
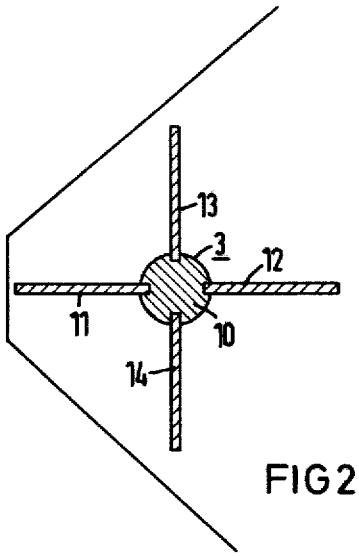
FIG. 2 is a cross section taken along line II—II of FIG. 1.

In a 1000 A current feed according to FIGS. 1 and 2, the contact elements 3 and 22 consist substantially of electrolytic copper with soldered contacts 8 and 25 of fine silver. The contact surface 9 is plane, while the contact surface 25 is made spherical with a sphere radius of about 80 to 100 mm. The mass of the cold contact element 3 including the cooling fins 11 to 14 is about 300 g, while the movable contact element 22 has a mass of about 30 g. The cooling surface area of the cooling fins is about 100 $cm^2$ and the heat resistance between the contact point and the connection point of the superconductor 16 is between 0.5 and 1 K/W. If the warm contact element 22 which is initially at a temperature of about 280 to 300 K, is then joined to the cold contact element 3 at the temperature of the helium bath 2 of about 4 K, the temperature gradient occurring in the process along the cold contact element 3 is broken down again practically completely after about 30 sec.

Figure 3:
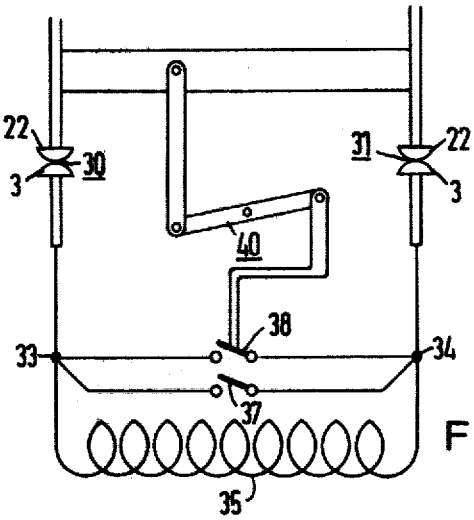
FIG. 3 is a schematic diagram of current feeds in connection with an additional shorting switch.

In FIG. 3 two current feeds 30 and 31 which correspond to the current feed according to FIG. 1 and are connected to the ends 33 and 34 of a superconducting magnet coil 35 are shown schematically. The coil ends 33 and 34 can be shorted electrically through a continuous current switch 37. The continuous current switch 37 is shunted by a further shorting switch 38, which is connected by means of a mechanical positioning device 40, only indicated in the figure, to the movable contact elements 22 of the current feeds 30 and 31 in such a manner that it can be opened only if the contact elements 3 and 22 of the current feeds are in the closed state, but that it always remains closed immediately before and during a separation of these contact elements. This measure avoids the possibility that, in the disconnected state of the current feeds, when a continuous current flows in the coil 35 and the continuous-current switch 37, this switch will be damaged or even destroyed by inadvertent opening of these switches and that very high electric voltages will occur at the coil ends 33 and 34.

What is claimed is:

1. In a current feed for a superconducting magnet coil which is cooled by a cryogenic medium and the coil ends of which can be short circuited by a continuous current switch, with a disconnecting device at each coil end which comprises a stationary contact member which is connected to the respective coil end and is included in the cooling effect of the cryogenic medium, a movable contact member connected to a current supply, and a mechanical actuating device for joining the contact members with a predetermined contact pressure and for separating them after the magnet coil is short-circuited, the improvement comprising:

(a) the mass ratio of the cooled contact element to the movable contact element being at least 5:1;

(b) the cooled contact element being of elongated shape in the current flow direction and having, at its end facing away from the contact region, means for enlarging the surface area, said end being connected to an end of the coil; and (c) the thermal resistance of the cooled contact element between the contact region and the connection point of the coil end being at least 0.2 kelvin per watt for each 1000 amperes of current maximally to be transmitted.

2. The improvement according to claim 1, wherein said mass ratio of said cooled contact element to the movable contact element is at least 10:1.

3. The improvement according to claim 1 wherein said means for enlarging comprise cooling fins at the end of said cooled contact element facing away from the contact zone.

4. The improvement according to claim 1 wherein the thermal resistance of said cooled contact element is at least 0.5 kelvin per watt for each 1000 amperes of current maximally to be transmitted.

5. The improvement according to claim 1 wherein the thermal resistance of said cooled contact element is at most 3 kelvin per watt and preferably at most 1 kelvin per watt for each 1000 amperes of current maximally to be transmitted.

6. The improvement according to claim 1 wherein the length of said cooled contact element in the current flow direction is at least twice as large as its average dimension in the direction perpendicular thereto.

7. The improvement according to claim 1 wherein at least one of the contact surfaces of the two contact elements is curved shaped and is preferably of spherical shape.

8. The improvement according to claim 1 wherein contact elements are made of copper and have on the sides facing each other a contact surface of fine silver.

9. The improvement according to claim 1 wherein the contact surface of the cooled contact element is located outside a bath of the cryogenic medium.

10. The improvement according to claim 1 wherein the contact force in the closed condition of the disconnecting device is at least 500 N and preferably at least 1000 N.

11. The improvement according to claim 1 and further including a shorting switch shunted across the continuous current switch and a mechanical positioning device coupled to keep the shorting switch open if the contact elements are joined together, in dependence on the switching state of the contact elements of the disconnecting devices and to keep it closed if the contact elements are separated.

12. The improvement according to claim 11, wherein said shorting switch is also cooled by the cryogenic medium.

13. The improvement according to claim 1 wherein the stroke of the movable contact element relative to the cooled contact element is limited to a predetermined value.

* * * * *